US006607298B2

(12) United States Patent
Ryhänen

(10) Patent No.: US 6,607,298 B2
(45) Date of Patent: Aug. 19, 2003

(54) TRANSPORTABLE CONCRETE STATION INCLUDING A MIXER COMPONENT AND A CONVEYOR ROTATABLE BETWEEN TRANSPORT AND WORKING POSITIONS

(75) Inventor: Viljo Ryhänen, Joensuu (FI)

(73) Assignee: Tecwill OY, Joensuu (FI)

( * ) Notice: Subject to any disclaimer, the term of this patent is extended or adjusted under 35 U.S.C. 154(b) by 0 days.

(21) Appl. No.: 10/112,037

(22) Filed: Apr. 1, 2002

(65) Prior Publication Data

US 2002/0191482 A1 Dec. 19, 2002

Related U.S. Application Data

(63) Continuation of application No. 09/946,557, filed on Sep. 6, 2001, now abandoned, which is a continuation of application No. 09/126,814, filed on Jul. 31, 1998, now abandoned, which is a continuation of application No. PCT/FI97/00052, filed on Jan. 31, 1997.

(30) Foreign Application Priority Data

Feb. 2, 1996 (FI) ..... U960066

(51) Int. Cl.[7] ..... B28C 7/04
(52) U.S. Cl. ..... 366/18; 366/35
(58) Field of Search ..... 366/6, 8, 16, 18, 366/19, 20, 26, 30, 33, 35, 37, 141; 414/21, 332, 528, 919

(56) References Cited

U.S. PATENT DOCUMENTS

| | | | | |
|---|---|---|---|---|
| 3,295,698 | A | 1/1967 | Ross et al. | |
| 3,343,688 | A | 9/1967 | Ross | |
| 3,476,270 | A | 11/1969 | Cox et al. | |
| 4,339,204 | A | 7/1982 | Placzek | |
| 4,579,496 | A | 4/1986 | Gerlach | 366/18 |
| 5,171,121 | A | 12/1992 | Smith et al. | 366/33 |
| 5,829,574 | A | 11/1998 | DelSanto | |
| 5,893,639 | A | 4/1999 | Tetoldini | |

FOREIGN PATENT DOCUMENTS

| | | |
|---|---|---|
| CA | 703402 | 2/1965 |
| DE | 1204990 | 11/1965 |
| DE | 2106334 | 8/1971 |
| DE | 3124031 | 12/1982 |
| DE | 3739645 | 5/1988 |
| DE | 3731623 | 3/1989 |
| DE | 4141068 | 6/1993 |

*Primary Examiner*—Charles E. Cooley
(74) *Attorney, Agent, or Firm*—Pillsbury Winthrop LLP

(57) ABSTRACT

A concrete mixing plant, with an aggregate storage to which a central part is fixed forms a transportable concrete station. In the concrete mixing plant there is a conveyor that transfers the aggregate to the aggregate mixer component, the mixer component containing the mixing equipment with its batching and weighing devices. A connecting unit is attached to the lower part of the mixer component with a joint, and to the upper side of the central part with a second joint. The jointed frame is attached with the top joint to the upper part of the mixer component and with a bottom joint to the top at the back of the central part. As a result the mixer component can be lifted from the transporting position to the mixing position and lowered to the transporting position, retaining all the cabling connections.

14 Claims, 5 Drawing Sheets

TRANSPORTABLE CONCRETE STATION INCLUDING A MIXER COMPONENT AND A CONVEYOR ROTATABLE BETWEEN TRANSPORT AND WORKING POSITIONS

This is a Continuation of National application Ser. No. 09/946,557 filed Sep. 6, 2001, now abandoned, which was a continuation of National application Ser. No. 09/126,814 filed Jul. 31. 1998, now abandoned, which was a continuation of International application No. PCT/FI97/00052 filed Jan. 31, 1997 which designated the U.S.

This invention applies to a concrete mixing plant.

At present there are concrete mixing plants that may be transported as a whole or assembled from parts.

The disadvantage with the transportation of a complete unit is that its dimensions are large, and special arrangements are needed for its transportation. As a result the whole operation becomes expensive, due to which the amount of concrete to be produced need to be large to make the transportation profitable. In addition the aggregate storage will remain either small or high, in which case the transportation is basically more difficult.

The disadvantage with the concrete plants assembled from parts is the laborious and time-consuming re-assembly of the parts transported separately, as the cabling for the equipment, for example, need to be connected.

SUMMARY OF THE INVENTION

The invention applies to a concrete mixing plant, the transport dimensions of which are small in relation to its concrete producing capacity. Moreover, the plant is designed to allow it to be readied for transport and installation in a minimum time with a minimum of labour. As a result the transfer of the concrete mixing plant is profitable even in cases where relatively small amounts of concrete are to be produced.

The above-mentioned disadvantages can be eliminated and the above-mentioned objectives can be reached with the concrete mixing plant as described in the invention.

The most important advantage of the invention is that the structure of the joints designed for the mixer component allows it to be swivelled rapidly into a transportation- or work-position without any detaching of cables etc. As a result a transfer to a new location is fast and inexpensive. In addition the folding of the wall-structure enables the aggregate storage to be much larger than the transport dimensions would otherwise indicate. In spite of this advantage the time needed for assembly and disassembly is not substantially increased.

BRIEF DESCRIPTION OF THE DRAWINGS

In the following, the invention is presented in detail referring to the figures attached.

DETAILED DESCRIPTION

Figure 1:
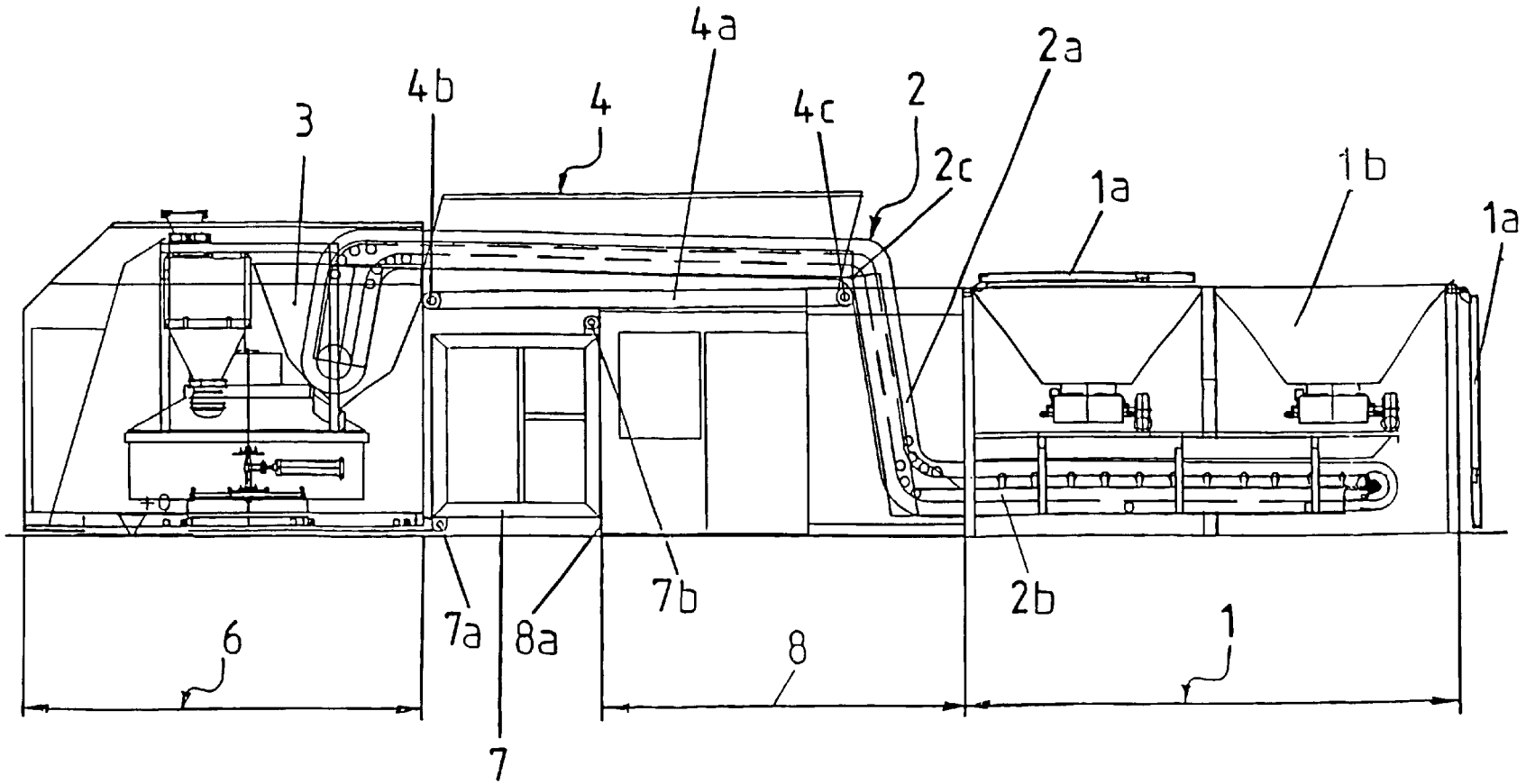
FIG. 1 shows the partially profiled side view of the concrete mixing plant as described in the invention, ready for transportation.
Figure 2:
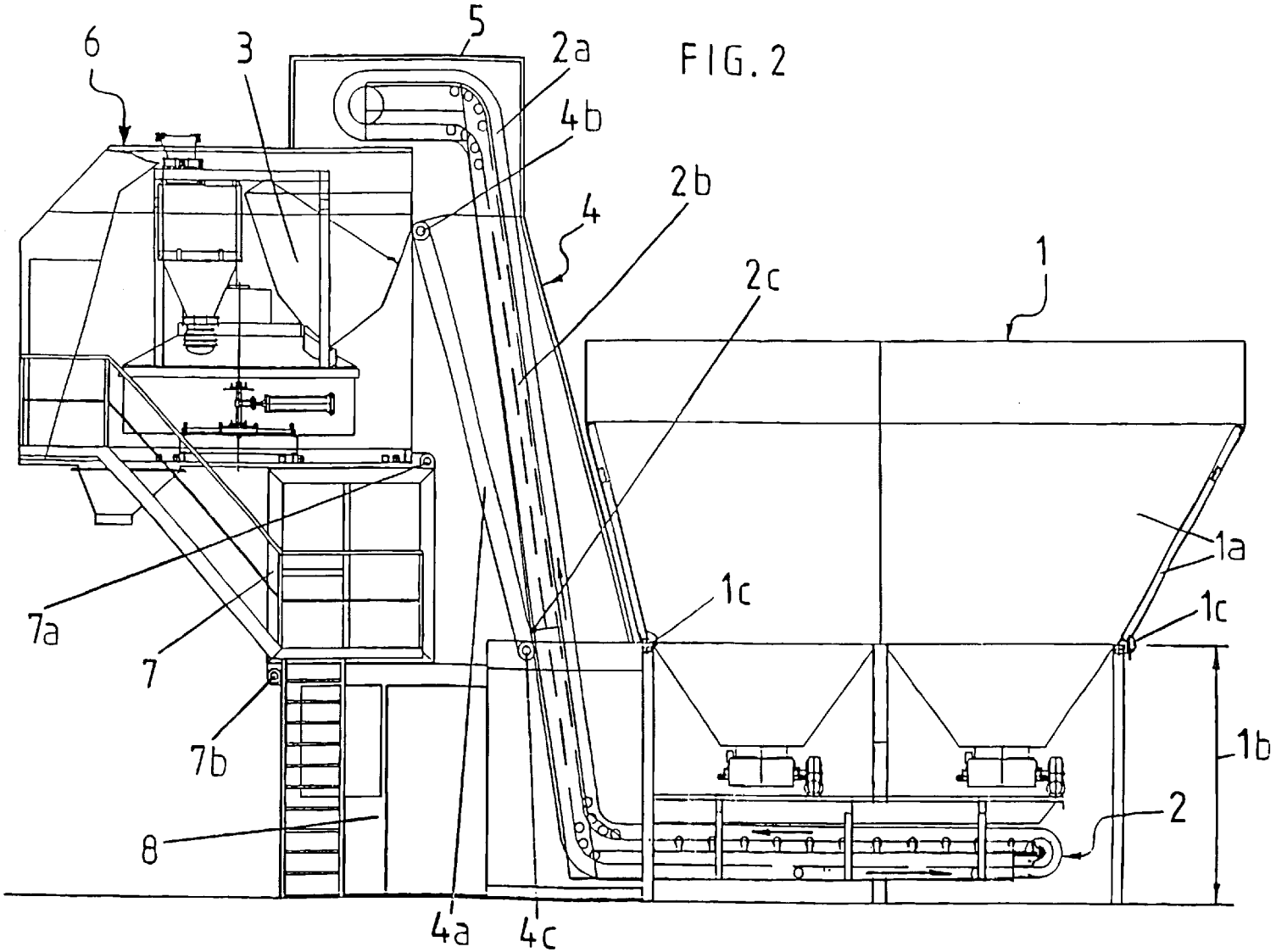
FIG. 2 shows the partially profiled side view of the concrete mixing plant of FIG. 1, ready for concrete production.
Figure 3:
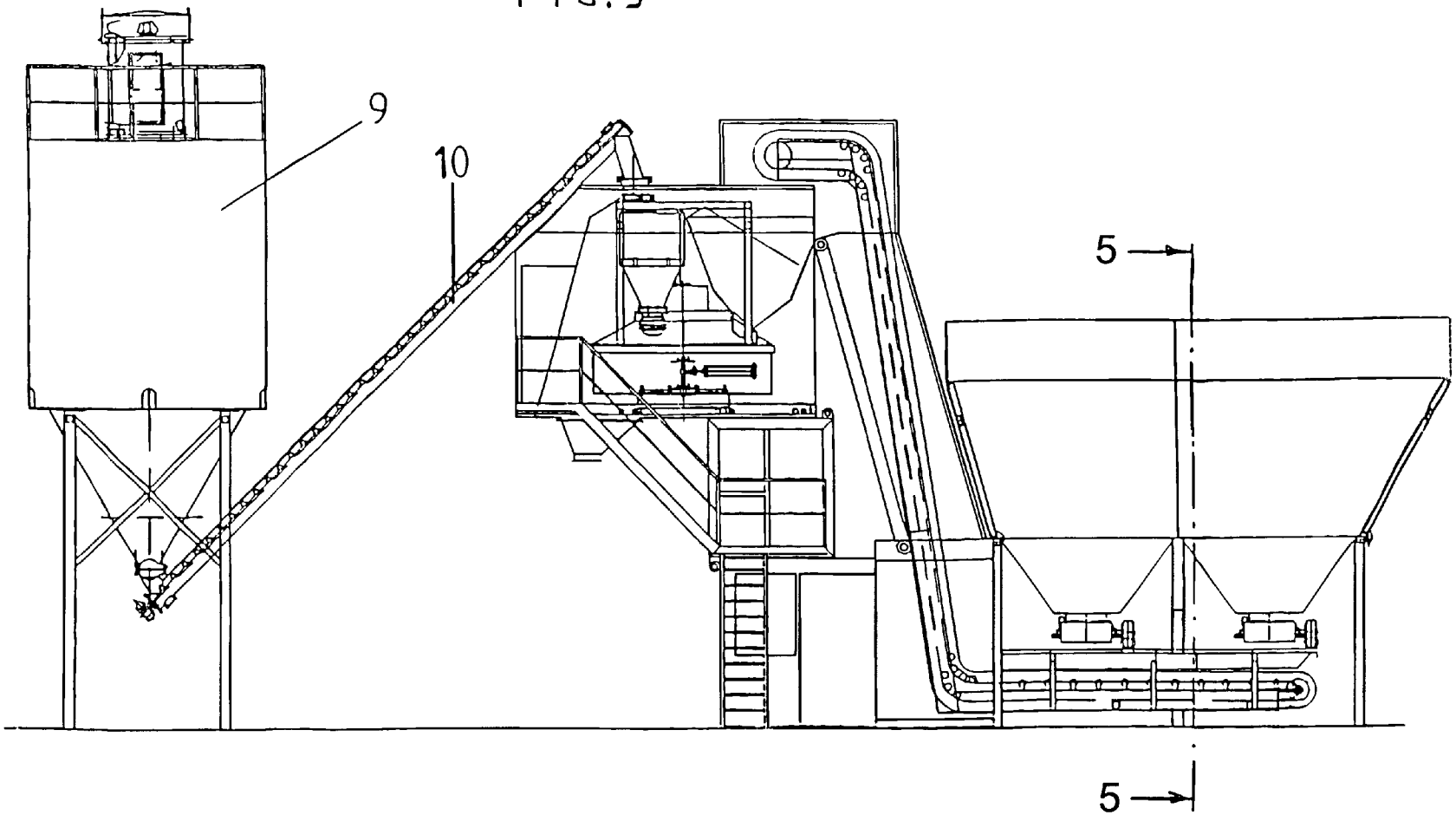
FIG. 3 shows the partially profiled side view of the concrete mixing plant of FIGS. 1 and 2.
Figure 4:
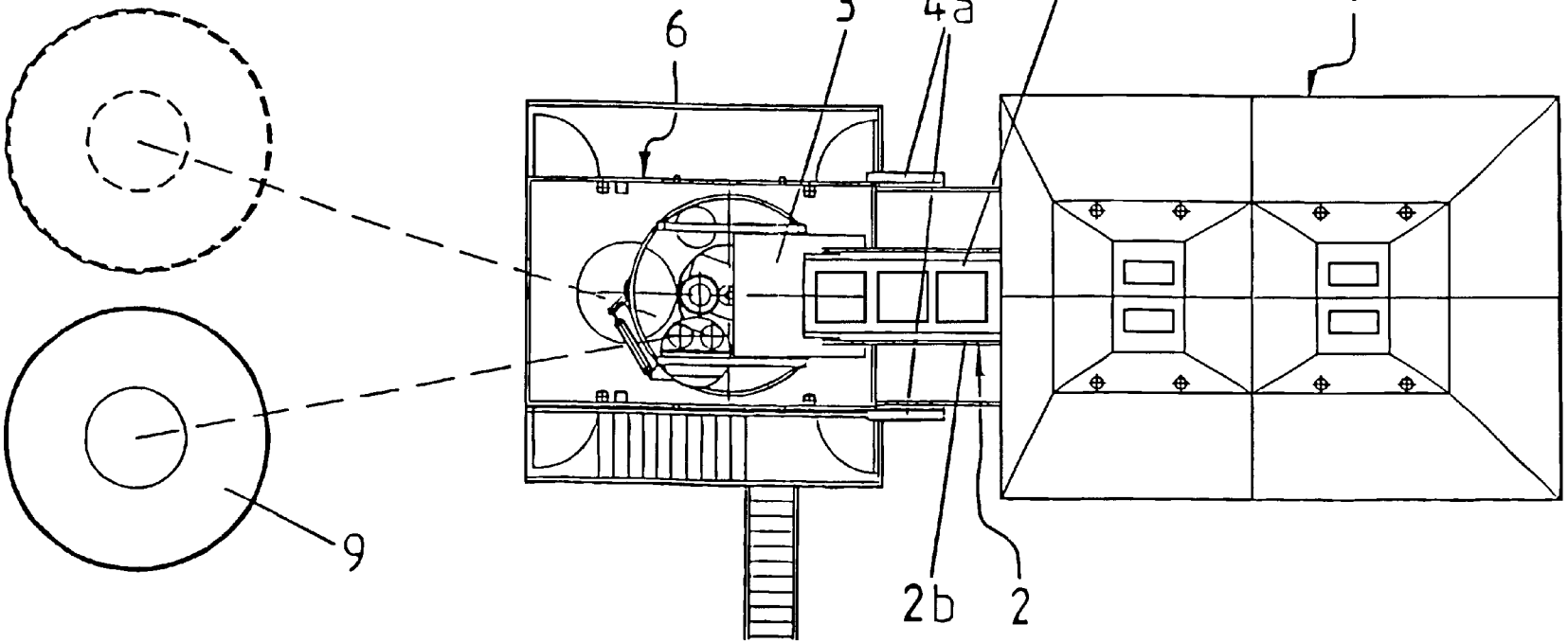
FIG. 4 shows the partially profiled top view of the concrete mixing plant of FIGS. 1, 2 and 3.
Figure 5:
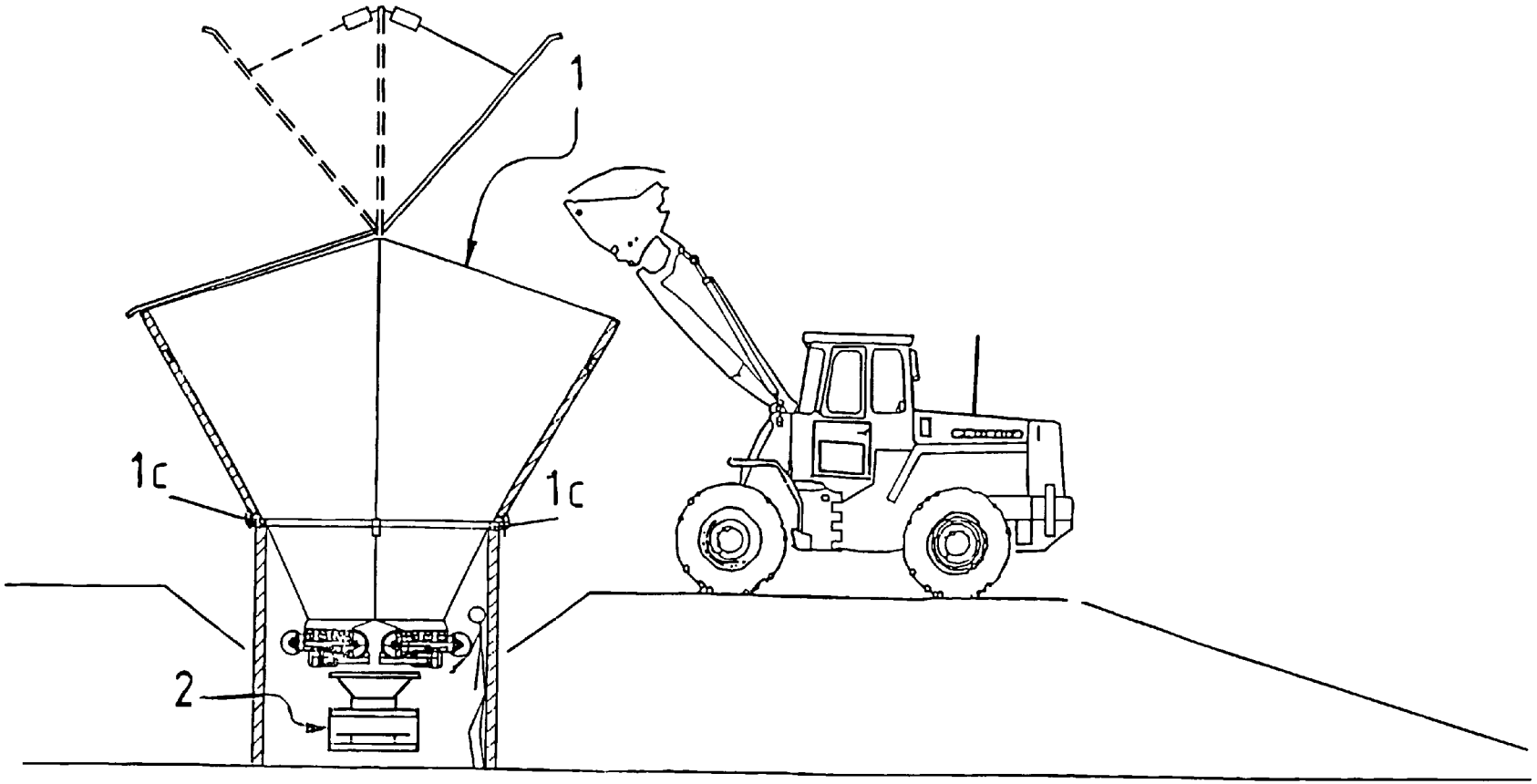
FIG. 5 shows the profiled front view partially in section taken along line 5—5 of FIG. 3 of the concrete mixing plant's aggregate storage.

The basic idea of this invention is, that the concrete mixing plant can be rapidly readied for transport and installation and that its transport dimensions are so small, that its transportation does not produce any additional problems.

The concrete mixing plant as shown in the figures is made up of the following parts and assemblies of parts which can all be manufactured of known metals, apart from those previously known components, the raw-material of which is not metal.

The aggregate storage (1) functions as the storage area for concrete aggregate, and is divided into several compartments for different types of aggregate. The lower part (1*b*) of the aggregate storage (1) has hinges or other types of attachments (1*c*) holding the walls (1*a*) above, enabling them to be folded for the transportation or erected for functional readiness in a very short period of time by lifting the walls (1*a*) up and attaching them to each other with known rapid attachment devices such as self-locking hooks, for example. The lower part (1*b*) of the aggregate storage (1) contains the aggregate batching devices.

The central part (8) is fixed to the aggregate storage (1), together forming a common unit. These two parts can be made to share a common body frame which then forms the base for both structures. The control room may be located in the central part (8).

The conveyor (2) for the aggregate is made up of a compartmentalized belt (2*a*), and its supporting frame (2*b*) with the necessary known equipment attached to it to move the belt (2*a*). This equipment includes a power source, belt-flexing rollers, bearing rollers etc. As a new feature there is a joint (2*c*) in the frame (2*b*) of the conveyor(2), enabling the folding of the upper part of the conveyor (2) over the central part(8) for transport without detaching or dismantling it. At the same time the height of the transportable unit is reduced.

The aggregate conveyor (2) carries the aggregate to the receiving area (3) (receiving hopper) from where the aggregate is directed to the mixer. The conveyor (2) and the receiving area (3) are both supported by weighing sensors, and function, therefore, as the weighing device for the aggregate. As a consequence, there is no need for a separate weighing device, usually a belt weigher, for the aggregate.

The conveyor (2) is inside the center cover (4). The center cover (4) is attached to a jointed frame (4*a*) which has a bottom joint (4*c*) and a top joint (4*b*). This jointed frame (4*a*) also functions as a support for the mixer component (6). The bottom joint (4*c*) is attached at the back to the top of the central part (8), and the top joint (4*b*) to the upper side of the mixer component (6).

The mixer component (6) contains a known concrete mixer, known cement- and waterscales, aggregate scales and all their necessary automation components. In addition, the mixer component (6) includes the receiving area (3) mentioned above. The frame structure in the mixer component (6) is very strong, enabling it to be moved with the help of the joint (7*a*) and the top joint (4*b*), using a car-crane or something similar, for example. The joint (7*a*) is attached to the lower part of the mixer component (6) and the top joint (4*b*) to the upper part of the mixer component (6). Both of these joints are on the side of the aggregate storage (1) of the mixer component (6).

The function of the connecting unit (7) is to act as a movable connecting structure for the mixer component (6) and the central part (8): it enables the erecting of the mixer component (6) into a working position. The shape of the connecting unit (7) in the figure is shown to be rectangular, but other shapes, a cube for example, can be used. The frame of the connecting unit (7) is strong to make it withstand the weight of the mixer component (6). The connecting unit (7) is attached to the mixer component (6) with the joint (7*a*) mentioned above, and in the opposite angle to the joint (7*a*) there is a joint (7*b*) attached to the front upper side (8*a*) of the central part (8).

To sum up, the connecting unit (7) is attached with the joint (7*a*) to the lower part of the mixer component (6) and with the joint (7*b*) to the front upper side (8*a*) of the central part (8). The jointed frame (4*a*) is attached with the top joint (4*b*) to the upper part of the mixer component (6) and with the bottom joint (4*c*) to the top at the back of the central part (8). As a result the mixer component (6) can be lifted from the transporting position to the mixing (working) position and lowered to the transporting position, retaining all the cabling connections, even with the conveyor (2) in its place—the joint (2*c*) enabling the turning of the conveyor.

The joints described above can be manufactured with known techniques (a metal sleeve containing a slidebearing, for example) or using known components, for example various bearings.

The erected mixer component (6) stays easily in its position with the help of the jointed frame (4*a*), no special fixing is needed.

For transport the mixer component (6), the connecting unit (7), and the central part (8)/aggregate storage (1) can be locked together in such a way that their transportation may be effected with the help of wheels positioned under the system. Alternatively, the whole may be lifted on any conventionally known transporting platform.

The concrete mixing plant's equipment- and working areas may be covered and insulated to ensure faultless operation in extreme conditions.

The binding agent, for example, cement needed in the production of concrete is obtained from a separate binding agent silo (9) from where it can be moved to the mixer component (6) with the help of a screw-conveyor (10), for example.

The installation for operational readiness of the concrete mixing plant is effected as follows: The mixing component (6) and the connecting unit (7) are detached from each other. A crane is used to lift the mixer component (6) in position: the connecting unit (7) seats itself on top of the central part (8), the conveyor (2) finds its place at the same time, and the mixer component (6) locks itself in place due to the jointed frame (4*a*). Next the walls (1*a*) of the aggregate storage (1) are folded out along the hinges (1*c*) and locked in their positions. The binding agent silo (9) is lifted in its position and the screw-conveyor (10) is connected to the binding agent weighing scale. Finally, servicing platforms, walkways and the top cover (5) are lifted in their positions and attached with rapid attachment devices.

To dismantle the plant for transportation follows a procedure the order of which is opposite to the above.

It is clear to a person of ordinary skill in the art that the invention is not limited just to its advantageous form as depicted above, but that many modifications are possible within the scope of the innovation as described.

I claim:

1. A concrete mixing plant, comprising:

a central part;

a mixer component;

an aggregate storage component fixed to the central part;

a connecting unit rotatably attached to a first joint on a lower part of the mixer component and rotatably attached to a second joint on an upper part of the central part so that the connecting unit can be rotated on the first and second joints from a transport position, in which the connecting unit is disposed horizontally between the central part and the mixer component, to a working position, in which the mixer component sits on the connecting unit;

a jointed frame including a top joint at one end rotatably connected to an upper part of the mixer component and a bottom joint at another end rotatably connected to the upper part of the central part so that the jointed frame can be rotated from the transport position, in which the jointed frame is over the central part and the connecting unit, to the working position, in which the jointed frame supports the mixer component; and a conveyor, that extends between the aggregate storage component and the mixer component, attached to the jointed frame, wherein the conveyor includes a joint parallel to the bottom joint to enable the conveyor to move with the mixer component between the transport and working positions.

2. A concrete mixing plant according to claim 1, wherein the mixer component includes mixing equipment having a cooperating batching and weighing device.

3. A concrete mixing plant according to claim 1, wherein the conveyor includes a compartmentalized belt.

4. A concrete mixing plant according to claim 1, wherein the aggregate storage component includes a plurality of compartments that store a plurality of types of aggregates.

5. A concrete mixing plant according to claim 1, wherein the aggregate storage component includes walls that are rotatable from the transport position, in which the walls are folded down, to the working position, in which the walls are erected and connected to each other.

6. A concrete mixing plant according to claim 1, further comprising:

a cover attached to the jointed frame that covers the conveyor.

7. A concrete mixing plant according to claim 1, wherein the mixer component includes a hopper that receives the aggregate from the conveyor.

8. A concrete mixing plant according to claim 1, further comprising:

a silo that stores binding agent; and a second conveyor that delivers the binding agent from the silo to the mixer component.

9. A concrete mixing plant according to claim 8, wherein the binding agent is cement.

10. A concrete mixing plant according to claim 8, wherein the second conveyor is a screw conveyor.

11. A concrete mixing plant according to claim 1, further comprising:

a top cover that covers a top of the conveyor when the jointed frame is in the working position.

12. A concrete mixing plant according to claim 1, further comprising:

a control room in the central part.

13. A concrete mixing plant according to claim 1, wherein the conveyor includes a supporting frame.

14. A concrete mixing plant according to claim 13, wherein the supporting frame includes at least one of a power source, belt-flexing rollers and bearing rollers.

* * * * *